US006329889B1

(12) United States Patent
Puoskari

(10) Patent No.: US 6,329,889 B1
(45) Date of Patent: Dec. 11, 2001

(54) COUPLING ELEMENT AND HIGH-FREQUENCY FILTER

(75) Inventor: Jukka Puoskari, Tupos (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/327,704

(22) Filed: Jun. 8, 1999

(30) Foreign Application Priority Data

Jun. 12, 1998 (FI) ..... 981362

(51) Int. Cl.[7] ..... H01P 1/201; H01P 1/00; H01P 5/12

(52) U.S. Cl. ..... 333/202; 333/212; 333/230

(58) Field of Search ..... 333/202, 203, 333/206, 212, 230, 219.1, 222

(56) References Cited

U.S. PATENT DOCUMENTS

| | | | |
|---|---|---|---|
| 4,453,146 | 6/1984 | Fiedziuszko . | |
| 4,890,078 | 12/1989 | Radcliffe . | |
| 5,608,363 * | 3/1997 | Cameron et al. | 333/202 |
| 5,684,438 | 11/1997 | Cavalieri D'Oro et al. . | |
| 5,748,058 | 5/1998 | Scott . | |
| 6,078,231 * | 6/2000 | Pelkonen | 333/203 |

FOREIGN PATENT DOCUMENTS

| | | | |
|---|---|---|---|
| 1942909 | 8/1969 | (DE) . | |
| 2161792 | 6/1973 | (DE) . | |
| WO 96/24172 | 8/1996 | (WO) | H01P/1/205 |

* cited by examiner

*Primary Examiner*—Benny Lee
*Assistant Examiner*—Stephen E. Jones
(74) *Attorney, Agent, or Firm*—Darby & Darby

(57) ABSTRACT

To realize electromagnetic couplings in a high-frequency filter a coupling element (100) comprises a first conductor (201), which has a first end (102) and a second end (103), and an insulating part (101). A portion of the first conductor, located between the first end and second end of the first conductor, is wholly surrounded by the insulating part. On both sides of said portion the first conductor comprises a portion which is outside the insulating part. The insulating part is arranged so as to become attached inside the high-frequency filter.

10 Claims, 3 Drawing Sheets

COUPLING ELEMENT AND HIGH-FREQUENCY FILTER

TECHNOLOGICAL FIELD

The invention relates in general to electrical and mechanical constructions in high-frequency filters. Particularly the invention relates to the mechanical and electrical construction of a coupling element that can provide desired electromagnetic couplings between parts in a high-frequency filter.

BACKGROUND OF THE INVENTION

A high-frequency filter is a filter the operating frequency of which falls in the range of a few hundred megahertz to tens of gigahertz. Known high-frequency filters are based on a few known basic resonator types. Resonator types include the helix resonator, in which the inner conductor is a cylindrical coil conductor and the outer conductor an electrically conductive casing; the dielectric resonator, in which the inner conductor is the electrically conductive coating of a hole formed in the dielectric body block and the outer conductor is the coating on the outer surface of that same body block; and the coaxial resonator, in which the inner conductor is a straight conductor the cross section of which is constant or changes in a step-like manner at some points, and the outer conductor is an electrically conductive casing not unlike the one in the helix resonator. The filter types are called helix filters, dielectric filters or coaxial filters according to the resonator type used. The present invention is applicable to filters in which the resonators' outer conductor is the electrically conductive casing. Resonators are also called filter circuits, and each portion of the casing that includes the inner conductor of a resonator is called a compartment.

In known high-frequency filters, the desired zeroes in the filter's frequency response are realized by means of link chains. To adjust the coupling, specially designed coupling elements are needed. The couplings required for achieving the desired response may be capacitive or inductive in nature or they may have both capacitive and inductive characteristics. A disadvantage of the link chain is that when a portion of the chain is adjusted, the adjustment tends to have a considerable effect on inter-circuit couplings as well as on the frequency, bandwidth and other characteristics of the circuits. Therefore, it is very difficult to set the specifications for the link chain. Because of the nature of the coupling and the construction of the filter the electrical implementation and mechanical construction of the coupling elements are unique in each individual case and therefore the coupling elements are expensive and laborious to manufacture. In addition, the assembly process is hard to automate.

U.S. Pat. No. 5,608,363 discloses different coupling methods in a filter construction which comprises at least two parallel resonator rows. The frequency response zeroes in the filter are realized by means of coupling elements attached to the walls between the resonator cavities. Disadvantages of the coupling elements described in the patent include the need for an economical and reliable attachment method for the necessary insulating material and the coupling element proper.

SUMMARY OF THE INVENTION

An object of the present invention is to provide a coupling element which can be applied to arrange inter-resonator couplings in a high-frequency filter and which has a simple construction and operation and is mechanically strong.

Another object of the invention is to provide a coupling element which can be generally used especially in conjunction with filter constructions with thin walls. A further object of the invention is to provide a coupling element the manufacture and end use of which can be easily automated and are therefore economically advantageous.

The objects of the invention are achieved by a construction combining an electrically conductive element, which has specifications as desired, and insulating material separating said conductive element from the rest of the construction, which insulating material may at the same time serve as a connecting surface to connect the construction so as to become part of a filter.

The coupling element according to the invention is characterized in that it comprises

- a first conductor which has a first end and second end,
- an insulating part, such that
- a portion of the first conductor located between the first end and second end of the first conductor is wholly surrounded by the insulating part,
- on both sides of said portion the first conductor comprises a portion which is outside the insulating part,
- the insulating part is arranged so as to become attached inside a high-frequency filter.

The invention also pertains to a high-frequency filter which comprises a first resonator and second resonator such that the first resonator has an inner conductor and the second resonator has an inner conductor and the inner conductors are surrounded by an electrically conductive casing comprised of compartments. It is characterized in that to provide electromagnetic couplings between resonators it comprises a coupling element which comprises

- a first conductor which has a first end and second end,
- an insulating part, such that
- a portion of the first conductor located between the first end and second end of the first conductor is wholly surrounded by the insulating part,
- on both sides of said portion the first conductor comprises a portion which is outside the insulating part,
- the portion on a first side of said portion and outside the insulating part is located in the same casing compartment with the inner conductor of the first resonator, and the portion on a second side of said portion and outside the insulating part is located in the same casing compartment with the inner conductor of the second resonator.

The invention further pertains to a method for manufacturing a coupling element in a high-frequency filter. The method according to the invention is characterized in that it comprises steps in which

- a portion between the ends of a conductor is surrounded with insulating material such that on both sides of said portion the conductor comprises a portion which is outside the insulating part
- the entity comprised of the insulating material and conductor is placed inside an electrically conductive casing in a high-frequency filter, and
- the entity comprised of the insulating material and conductor is attached to an inner surface of the casing.

The coupling element according to the invention has at least one electrically conductive part, or a conductor, and an insulating part which may at the same time serve as a connection surface to connect the construction so as to become part of a filter. A separate connection part may also be used. The insulating part is flat, i.e. it has in two perpendicular directions a dimension which is substantially greater than the dimension of the insulating part in a third direction which is perpendicular to the other two directions. The conductor or conductors are elongated and placed such that part of every conductor travels inside the insulating part and projects from the insulating part at a point which is intended to be located near a certain inner conductor of a resonator. Conductor parts traveling inside the insulating part are directed mainly to those directions in which the insulating part has a significant dimension.

The coupling element according to the invention is placed inside a filter casing such that the insulating part or a separate connection part if one is used, is positioned against a certain even surface of the casing. The surface in question is preferably the "top" or "bottom" of the casing, which terms refer to those surfaces of the casing that are perpendicular to the longitudinal axes of the inner conductors of the resonators. Then the conductor in the coupling element extends from a first compartment of the casing to a second compartment. If the coupling element has two conductors, the first of them extends from a first compartment of the casing to a second compartment, and the second extends from a third compartment to a fourth compartment such that said first compartment may be the same as the third compartment and the second compartment may be the same as the fourth compartment.

The coupling element according to the invention eliminates the problems occurring in connection with the link chain. Since it is a separate component in the filter, it does not significantly affect other than the desired circuit couplings or circuit frequency so that the dimensioning of the coupling element is easier than in traditional solutions. The coupling element does not include long chains which typically are made of conductive wires of different strengths and the mechanical durability of which is poor in connection with mounting and filter tuning. The coupling element provides easy capacitive, inductive, mixed capacitive-inductive or tap coupling to parallel sequential or non-sequential resonator circuits.

BRIEF DESCRIPTION OF DRAWINGS

The invention will now be described in more detail with reference to the preferred embodiments presented by way of example and to the accompanying drawing wherein.

Like elements in the drawing are denoted by like reference designators.

DETAILED DESCRIPTION OF THE INVENTION

Figure 1:
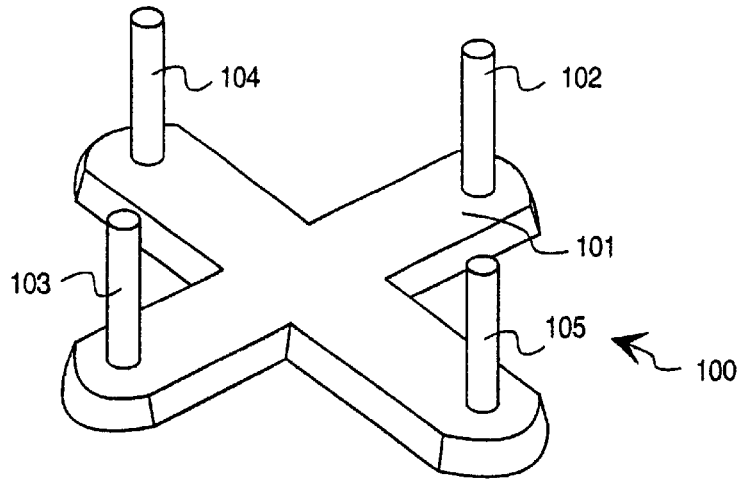
FIG. 1 shows a perspective of a coupling element according to the invention.

FIG. 1 shows a coupling element 100 which comprises an insulating part 101 and conductors, of which are shown the conductor ends, i.e. the vertical portions 102, 103, 104, and 105 in the drawing. The insulating part is flat and shaped like a right-angled cross; flatness meaning that the insulating part has in the direction of the arms of the cross a dimension which is substantially greater than in the vertical direction of the drawing, said vertical direction being perpendicular to the direction of the arms of the cross. It is not essential that the insulating part be shaped like a cross; other possible shapes are disclosed later on. Also, the relative lengths of the arms of the cross-shaped insulating part are not significant as regards the invention, but the arms may be all equally long, equally long in pairs, one of unequal length and the others equally long, two equally long and the others of unequal length or all of unequal length.

Figure 2A:
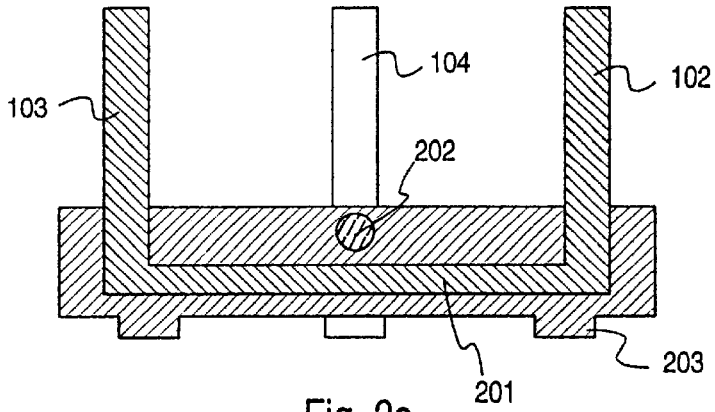
FIG. 2*a* shows a longitudinal section of the coupling element shown in FIG. 1.

FIG. 2*a* illustrates the location of the conductors with respect to the insulating part. The conductor the ends of which comprise vertical portions 102 and 103 is called the first conductor 201. So, the first conductor 201 extends from a first arm of the cross-shaped insulating part to the opposite arm such that between vertical portions 102 and 103 the conductor travels inside the insulating part. The conductor the ends of which comprise vertical portions 104 and 105 is called the second conductor 202. It also comprises a horizontal portion which travels inside the insulating part between two opposing arms. The horizontal portions of conductors 201 and 202 are located at different heights in the vertical direction, so they do not touch each other at the middle of the insulating part. However, an embodiment of the invention can be disclosed in which the conductors traveling between opposing arms do touch each other at the middle of the insulating part. Directional terms such as vertical, horizontal and height only refer to the attached drawing and do not limit the invention in any way.

FIG. 2*a* shows a substantially even lower surface of the insulating part 101 which lower surface, however, comprises attachment formations 203 which in this embodiment are protruding pins. The connection formations may also comprise holes or cavities as well as other mechanical parts known to one skilled in the art. If no separate connection part is used, the coupling element according to the invention uses the lower surface of the insulating part to become attached to the inside top or bottom of the casing. In that case, the purpose of the attachment formations is to add to the mechanical strength of the construction, guide the coupling element during mounting, and to hold the coupling element in place prior to final connection to the filter by soldering, welding or gluing. The coupling element according to FIG. 2 is intended to be connected to the casing such that the pins 203 coincide with holes or cavities on the surface of the casing.

Figure 2B:
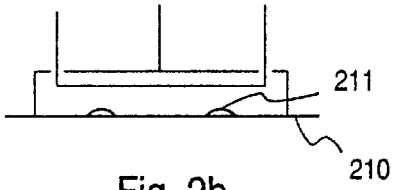
FIG. 2*b* shows a modification of the coupling element shown in FIG. 2*a,*

As was stated above, it is possible to use, in addition to the parts shown in FIG. 2*a*, a separate connection part, or attachment base, by means of which the coupling element is attached to the filter. An exemplary attachment base 210 is shown in FIG. 2*b*. Whether or not a separate attachment base is used depends on the attachment method selected. When using e.g. ultrasonic or resistance welding, the use of a separate attachment base is not necessary because with a suitable insulating material the coupling element can be connected directly to the inner surface of the casing. Typically, a separate attachment base is used in conjunction with solder-based connecting methods. Then the coupling element can be attached to the filter simultaneously with the soldering stage included in the filter manufacturing process, and no separate connection steps are needed. Typically the attachment base is sheet-like in construction, but it may also include details 211 such as pins, cavities, holes, bumps, corrugations, folds and so on, which make installation and handling easier and add to the mechanical strength.

The insulating part is preferably manufactured by means of injection-molding using a suitable polymer or polymer compound or some other insulating material applicable in the injection-molding method. The conductors become enclosed in the insulating part during the manufacture of the insulating part. If a separate attachment base is used, part of it is also left inside the insulating part during the manufacture of the insulating part so that in a completed coupling element the insulating part encloses parts of both the conductors and attachment base as shown in FIG. 2*b*. The invention is not limited to the use of injection-molding but also ultrasonic or resistance welding, gluing or soldering can be used in the assembly of the coupling element.

The shape of the cross section of the conductors and their specifications can be chosen according to the desired coupling characteristics and/or mechanical requirements. Typical cross section shapes include a rectangle and a circle. The length of a conductor depends on its other characteristics and also on whether an inductive or a capacitive coupling to the resonators is to be provided by the conductor. Suitable dimensions for the conductors can be found out by experimenting.

Figure 3:
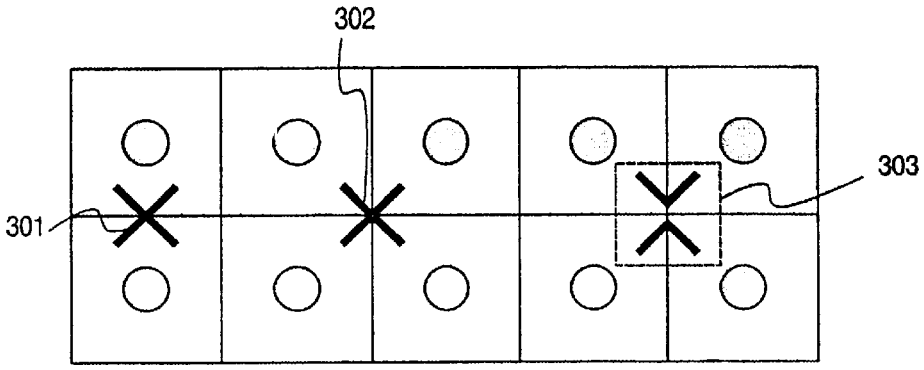
FIG. 3 shows coupling elements according to the invention in a filter.

The coupling element according to the invention can be used to provide many kinds of coupling between resonator circuits in a filter in order to achieve a desired frequency response. FIG. 3 shows different coupling methods in a filter construction which comprises at least two parallel resonator rows. Coupling element 301 provides a connection between two parallel non-sequential circuits, and coupling element 302 is placed at the intersection of four casing walls such that each of the coupling element branches is located in a compartment of its own. Coupling elements 301 and 302 may be either in accordance with FIG. 2*a*, in which case the conductors, which are placed crosswise, do not touch each other at the middle of the coupling element, or such that the conductors touch each other at the middle of the coupling element.

Coupling element 303 shown in FIG. 3 has two conductors, but the "horizontal" portions of the conductors do not extend from an arm to the opposite arm but to the adjacent arm. In terms of FIG. 1, vertical portions 102 and 104 would then be the ends of a first conductor, and vertical portions 103 and 105 would be the ends of a second conductor. The conductors do not touch at the middle of the insulating part (although this could be the case in another embodiment of the invention), so that coupling element 303 interconnects two sequential circuits in both resonator rows.

Figure 4A:
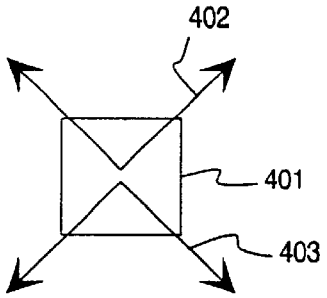
FIGS. 4*a*–4*g* show embodiments of the coupling element according to the invention.
Figure 4B:
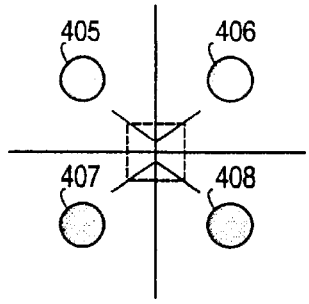
Figure 4C:
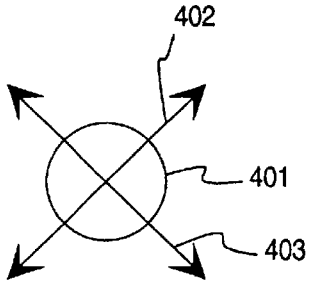
Figure 4D:
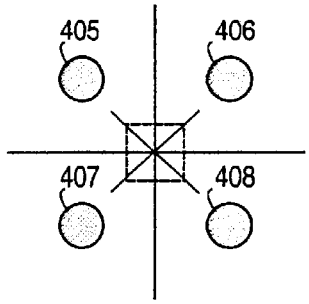
Figure 4E:
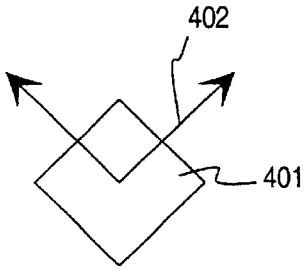
Figure 4F:
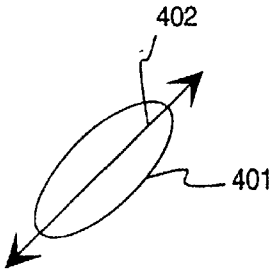
Figure 4G:
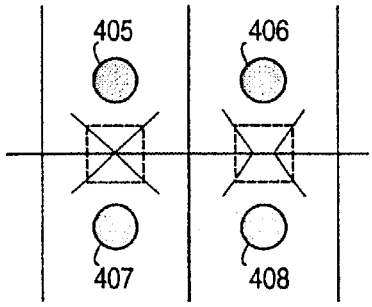

FIGS. 4*a* to 4*g* show alternative placements of conductors in the insulating part and alternative insulating part designs and alternative coupling element locations in a filter. The insulating part is generally marked by reference designator 401 regardless of the design alternative, and conductors are generally marked by reference designators 402 and 403. In FIGS. 4*b*, 4*d* and 4*g* depicting the placement of coupling elements in a filter, reference designators 405 to 408 refer to the inner conductors of the resonators and the straight lines around them represent the walls of the casing. The drawing schematically depicts the inner conductors as circles, which would indicate coaxial resonators, but the invention is applicable to helix resonators as well. The conductor placement alternatives, insulating part design alternatives, and coupling element placement alternatives depicted are mutually compatible so that conductors, for example, can be placed as shown in FIG. 4*a* in an insulating part the shape of which is in accordance with FIG. 4*f*.

Figure 5A:
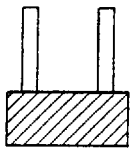
FIGS. 5*a*–5*d* show conductor connections in the coupling element according to the invention.
Figure 5B:
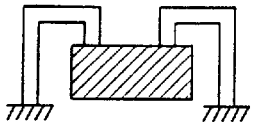
Figure 5C:
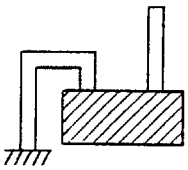
Figure 5D:
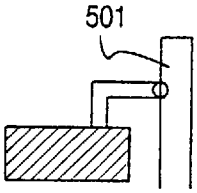

FIGS. 5*a* to 5*d* show possible ways to connect the conductors of the coupling element according to the invention. In FIG. 5*a* both ends of a conductor are free, in FIG. 5*b* both ends of a conductor are grounded, and in FIG. 5*c* one end of a conductor is free and the other end is grounded. FIG. 5*d* shows how one end of a conductor is connected by means of tapping to the inner conductor 501 of a resonator (a coaxial resonator in this case). All these connection alternatives can be used in conjunction with all the placement alternatives and insulating part designs described above and/or depicted in the drawing.

The coupling element according to the invention can be used as an interconnecting component enabling direct connection to a resonator: inductively through a link, capacitively by a "sniffer", i.e. a free end of a conductor placed in the vicinity of the capacitive end of the resonator's inner conductor, or by tapping directly to the resonator's inner conductor. The coupling element can also be used as a feedthrough component e.g. from the filter to a low-pass filter.

What is claimed is:

1. A high-frequency filter comprising:

a first resonator and a second resonator such that the first resonator has an inner conductor and the second resonator has an inner conductor and the inner conductors are surrounded by an electrically conductive casing having compartments, a coupling element to realize electromagnetic couplings between said first and second resonators, within said coupling element including an insulating part, within said coupling element a first conductor having a first end and a second end outside the insulating part, and wherein the portion between the first end and second end of the first conductor is wholly surrounded by the insulating part so that the first conductor and the insulating part are included in an integrated component having a first side and said component is arranged to be attached at said first side inside the the portion on a first side of said portion and outside the insulating part is located in the same casing compartment with the inner conductor of the first resonator, and the portion on a second side of said portion and outside the insulating part is located in the same casing compartment with the inner conductor of the second resonator;

wherein the insulating part is flat, having in a first and second mutually perpendicular directions a dimension which is substantially greater than the dimension of the insulating part in a third direction perpendicular to said two other directions, and the portion of the first conductor which is wholly surrounded by the insulating part is substantially perpendicular to said third direction.

2. The high-frequency filter of claim 1, wherein the first end of the first conductor is grounded.

3. The high-frequency filter of claim 1, wherein the first end and the second end of the first conductor are grounded.

4. The high-frequency filter of claim 1, wherein the first end and the second end of the first conductor are not grounded.

5. The high-frequency filter of claim 2, wherein the first end of the first conductor is tapped into the inner conductor of the first resonators.

6. A coupling element for realizing electromagnetic coupling in a high-frequency filter, comprising:

an insulating part and a first conductor having a first and second end outside the insulating part; wherein the portion between the first end and second end of the first conductor is wholly surrounded by the insulating part so that the first conductor and the insulating part are included in an integrated component and said component is arranged to be attached at a first side inside a housing of said high-frequency filter, wherein the insulating part is flat, having in a first and second mutually perpendicular directions a dimension which is substantially greater than the dimension of the insulating part in a third direction perpendicular to said two other directions, and the portion of the first conductor which is wholly surrounded by the insulating part is substantially perpendicular to said third direction.

7. The coupling element of claim 6, further comprising a second conductor, wherein said second conductor has a first and second end outside said insulating part and, the portion between the first end and second end of the second conductor is wholly surrounded by the insulating part and substantially perpendicular to said third direction.

8. The coupling element of claim 7, wherein said portion of the first conductor is straight and parallel to the direction of said first direction, and said portion of the second conductor is straight and parallel to said second direction perpendicular to the first direction.

9. The coupling element of claim 7, wherein said portion of the first conductor comprises a first section which is straight and parallel to said first direction and a second section which is straight and parallel to said second direction, and said portion of the second conductor comprises a first section which is straight and parallel to said first direction and a second section which is straight and parallel to said second direction.

10. A coupling element for realizing electromagnetic couplings in a high-frequency filter, comprising:

an insulating part and a first conductor having a first and second end outside the insulating part, wherein the portion between the first end and second end of the first conductor is wholly surrounded by the insulating part so that the first conductor and the insulating part are included in an integrated component, and said component is arranged to be attached at a first side inside the housing of said high-frequency filter, and comprising further a separate attachment base having an attachment surface, wherein said component is arranged to be attached inside the housing of said high-frequency filter by means of said attachment base, wherein the attachment base is sheet-like and has formations in order to make installation and handling easier and to add to its mechanical strength.

* * * * *